US005401175A

United States Patent [19]

Guimond et al.

[11] Patent Number: 5,401,175

[45] Date of Patent: Mar. 28, 1995

[54] MAGNETIC COAXIAL CONNECTOR

[75] Inventors: Ronald Guimond, Amesbury, Mass.; Stuart J. MacNeill, York Beach, Me.

[73] Assignee: M/A-Com, Inc., Lowell, Mass.

[21] Appl. No.: 83,086

[22] Filed: Jun. 25, 1993

[51] Int. Cl.[6] ..... H01R 11/30

[52] U.S. Cl. ..... 439/38; 439/39

[58] Field of Search ..... 439/38, 39, 40, 289, 439/92

[56] References Cited

U.S. PATENT DOCUMENTS

| | | | |
|---|---|---|---|
| 2,762,991 | 9/1956 | Chlavin . | |
| 2,773,239 | 12/1956 | Packer | 439/38 |
| 3,144,527 | 8/1964 | Tolegian | 439/38 |
| 3,363,214 | 1/1968 | Wright . | |
| 3,521,216 | 7/1970 | Tolegian . | |
| 3,651,447 | 3/1972 | Branco . | |
| 3,670,287 | 6/1972 | Keto . | |
| 3,786,391 | 1/1974 | Mathauser . | |
| 3,808,577 | 4/1974 | Mathauser . | |
| 3,810,258 | 5/1974 | Mathauser . | |
| 4,494,816 | 1/1985 | Tamburro . | |
| 4,588,241 | 5/1986 | Ardezzone . | |
| 4,690,495 | 1/1987 | Giannini | 439/40 |
| 4,772,212 | 9/1988 | Sotolongo . | |
| 4,844,582 | 7/1989 | Giannini . | |
| 4,867,704 | 9/1989 | Standke . | |
| 4,874,316 | 10/1989 | Kamon . | |
| 5,004,425 | 4/1991 | Hee . | |

*Primary Examiner*—Larry I. Schwartz
*Assistant Examiner*—Hien D. Vu
*Attorney, Agent, or Firm*—St.Onge Steward Johnson & Reens

[57] ABSTRACT

Several embodiments are shown for a quick connect-/disconnect microwave coaxial connector which is held together under magnetic force. In one embodiment, the ends of coaxial cables are provided with annular magnets and the end faces ground flat. A good low SWR coaxial connection is made and held by simply pushing the ends together. In another embodiment, ring magnets are employed to hold standard coaxial ends together while enabling their disconnection by pulling them apart. A magnetic adapter is used to facilitate coaxial connections.

2 Claims, 4 Drawing Sheets

MAGNETIC COAXIAL CONNECTOR

FIELD OF THE INVENTION

This invention relates to a quick connect/disconnect microwave type connector generally, and more specifically to such a coaxial connector using a magnetic coupling for holding it together.

BACKGROUND OF THE INVENTION

Magnetic force to hold connectors together have been used. See for example, the U.S. Pat. Nos. 3,363,214, 3,521,216, 3,651,447, 3,786,391, 3,808,577, 3,810,258, 4,844,582, 4,874,316, and 5,004,425. These connectors utilize various ways for aligning and arranging electrical connectors between cable ends, which are held together by magnetic force.

In the U.S. Pat. No. 2,762,991 to Chlavin, a hermetically-sealed connector is described having an inner and outer conductor with a glass insulator in between them for hermetic sealing. The inner conductor is shaped to receive a pin from a mating connector. No magnetic coupling is provided.

SUMMARY OF THE INVENTION

With a microwave connector in accordance with the invention, a quick connect/disconnect capability is provided. This is particularly useful and effective for coaxial type connectors with which a quality microwave connection having a low SWR (standing wave ratio) is obtained.

In accordance with one technique of the invention for forming a quick connect/disconnect microwave coaxial connector, a coaxial cable is used. The coax cable has an inner conductor, an outer conductor, and an insulative material in between the conductors and an outer insulative jacket mounted inside a cylindrical magnet. The cable and magnet terminate at a common end whose surface is made substantially flat. In this manner a flush fit between complementary-shaped connection tors can be made with microwave continuity with a low SWR, while the flush fitting magnets hold the connection together.

Although a flush mating of flat end surfaces can result in a quality microwave connection with DC coupling of the center and outer conductors, one can spring load the center conductors to assure positive contact pressure between center conductors.

In another form of the invention, a coaxial microwave connector is formed wherein center and outer conductors of a standard coaxial type make electrical contact in a conventional way, but are held together with appropriately polarized magnets that are arranged around the outer conductor.

It is, therefore, an object of the invention to provide microwave connectors that can be quickly connected and disconnected. It is a further object of the invention to provide a quick connect/disconnect microwave coaxial connector which is magnetically held together.

These and other objects and advantages of the invention can be understood from the following detailed description of several embodiment as shown in the drawings.

DETAILED DESCRIPTION OF THE DRAWINGS

Figure 1:
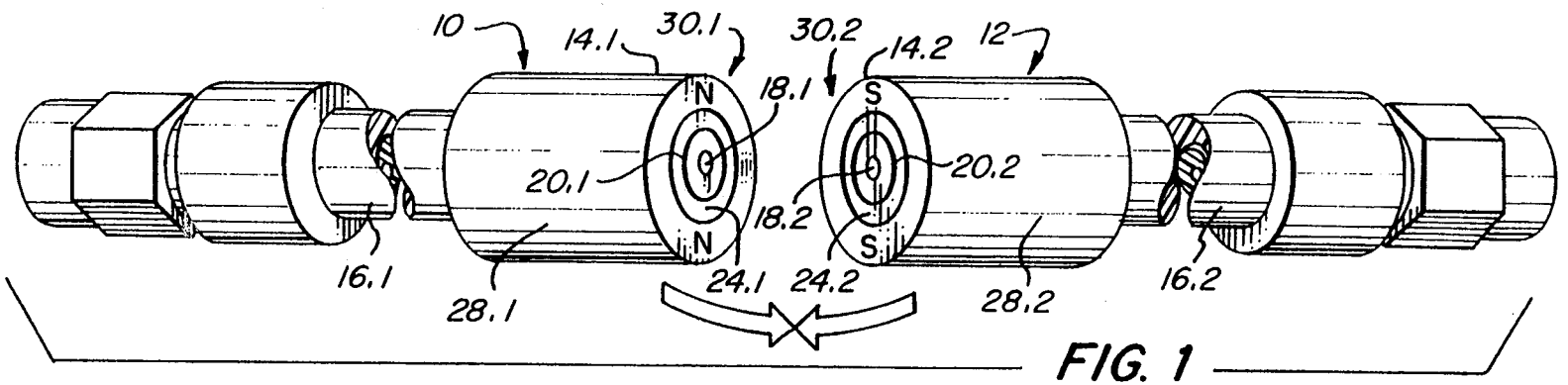
FIG. 1 is a perspective view of a pair of mating coaxial connectors in accordance with the invention.
Figure 2:
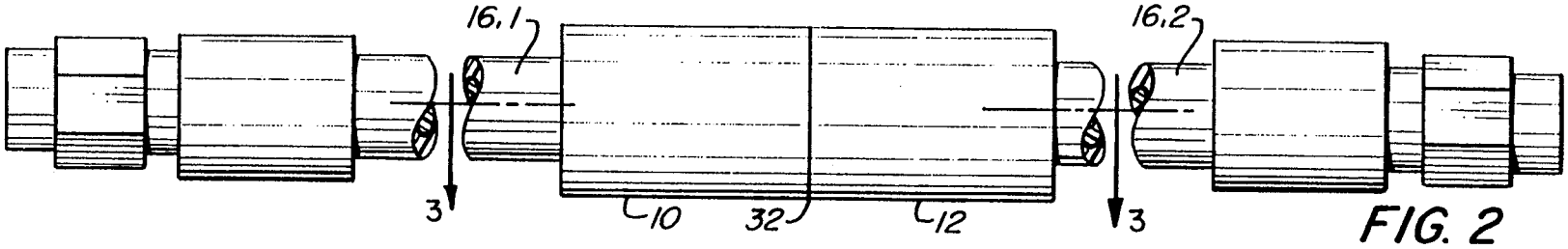
FIG. 2 is a side view in elevation of the connected coaxial connectors of FIG. 1.
Figure 3:
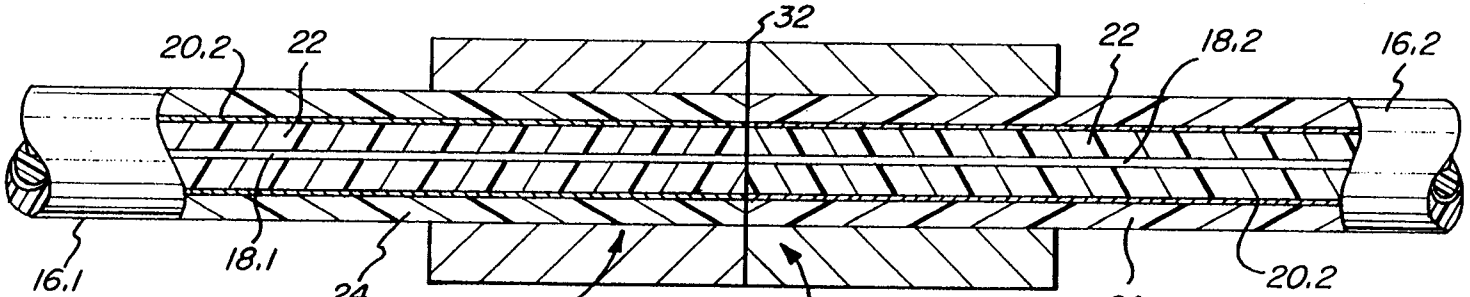
FIG. 3 is a side section view of the connected connectors of FIG. 2.

With reference to FIGS. 1, 2, and 3, a pair of mating microwave coaxial connectors 10, 12 are shown. Each connector 10, 12 is located at the end 14.1, 14.2 of standard coaxial cables 16.1, 16.2 formed with center conductors 18.1 and 18.2, outer, typically braided, conductors 20.1 and 20.2, and an annular insulative layer 22 between conductors 18, 20. An insulative jacket 24 is extruded over outer conductors 18, 20. The use of numbers to the right of decimal points signifies specific elements and without the decimal signifies either of the specific elements.

At each end 14.1 and 14.2 is a magnet 28.1 and 28.2 in a ring shape with a central bore in which the jackets 24 of the coaxial cables 16.1 and 16.2 are tightly affixed.

The magnets 28.1 and 28.2 are polarized in the sense that one has its north pole at an end 14.1. and the other a south pole at end 14.2. The ends 14 are ground and polished flat so that the ends of each center conductor 18, outer conductor 20, insulative layer 22 and magnet 28 are coplanar. This permits a flush fit at 32 of opposing connector faces 30.1 30.2 with excellent coupling of the coaxial circuit.

The substantially flat connector faces 20.1 and 30.2 are essentially perpendicular to the longitudinal axis of the cables 16 near ends 14 and when pushed together, are strongly held by magnets 28.1 and 28.2. The flatness of the end surfaces 30.1 and 30.2 provide a low SWR coupling between the connected coaxial cables 16 with a DC connection between opposite conductors 18 and 20.

Figure 5:
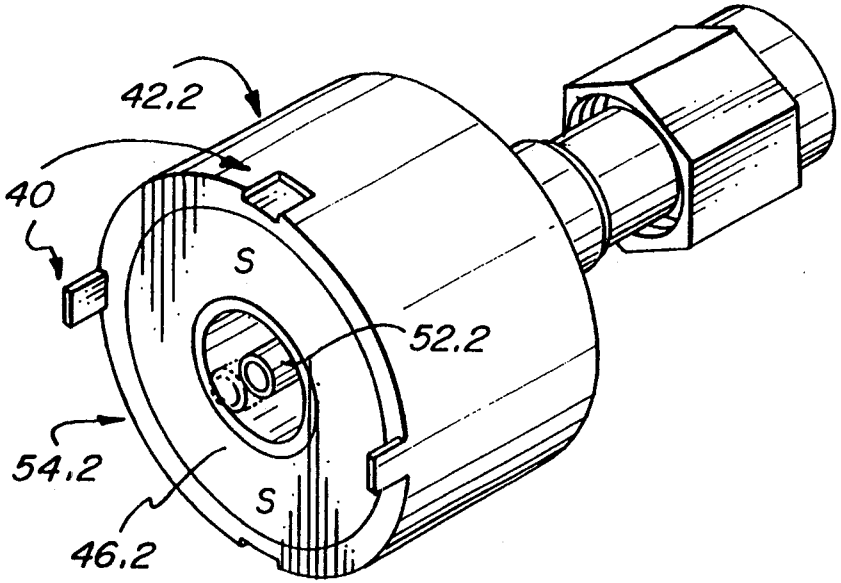
FIGS. 4 and 5 are perspective modified versions of coaxial connectors in accordance with the invention.
Figure 4:
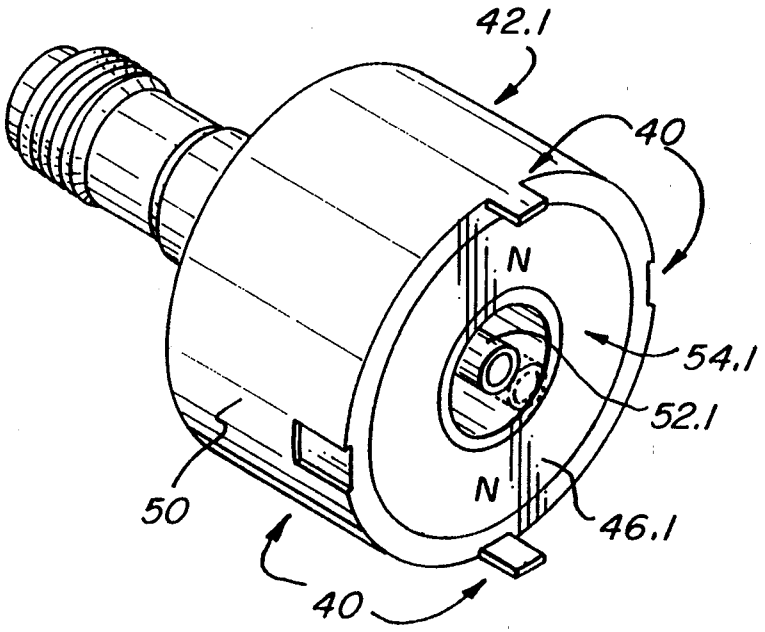

When desired, special alignment guides 40 are provided as illustrated in the connector embodiments 42.1 and 42.2 in FIGS. 4 and 5. Guides 40 comprise a perimeter wall 44 enclosing a magnet 46 with protruding edges 48 and receiving recesses 50. The guides 40 can be also used with the embodiment shown in FIGS. 1–3.

In FIGS. 4 and 5, each coaxial connector 42.1 and 42.2 has its internal conductor 52 spring loaded to assure positive DC abutting contact when the connectors 42.1 and 42.2 are pushed together. Again, flat planar end surfaces 54.1 and 54.2 are formed in the connectors 42 to assure a flush abutting fit with a low SWR connection while being held together with annular magnets 46.1 and 46.2.

Figure 6:
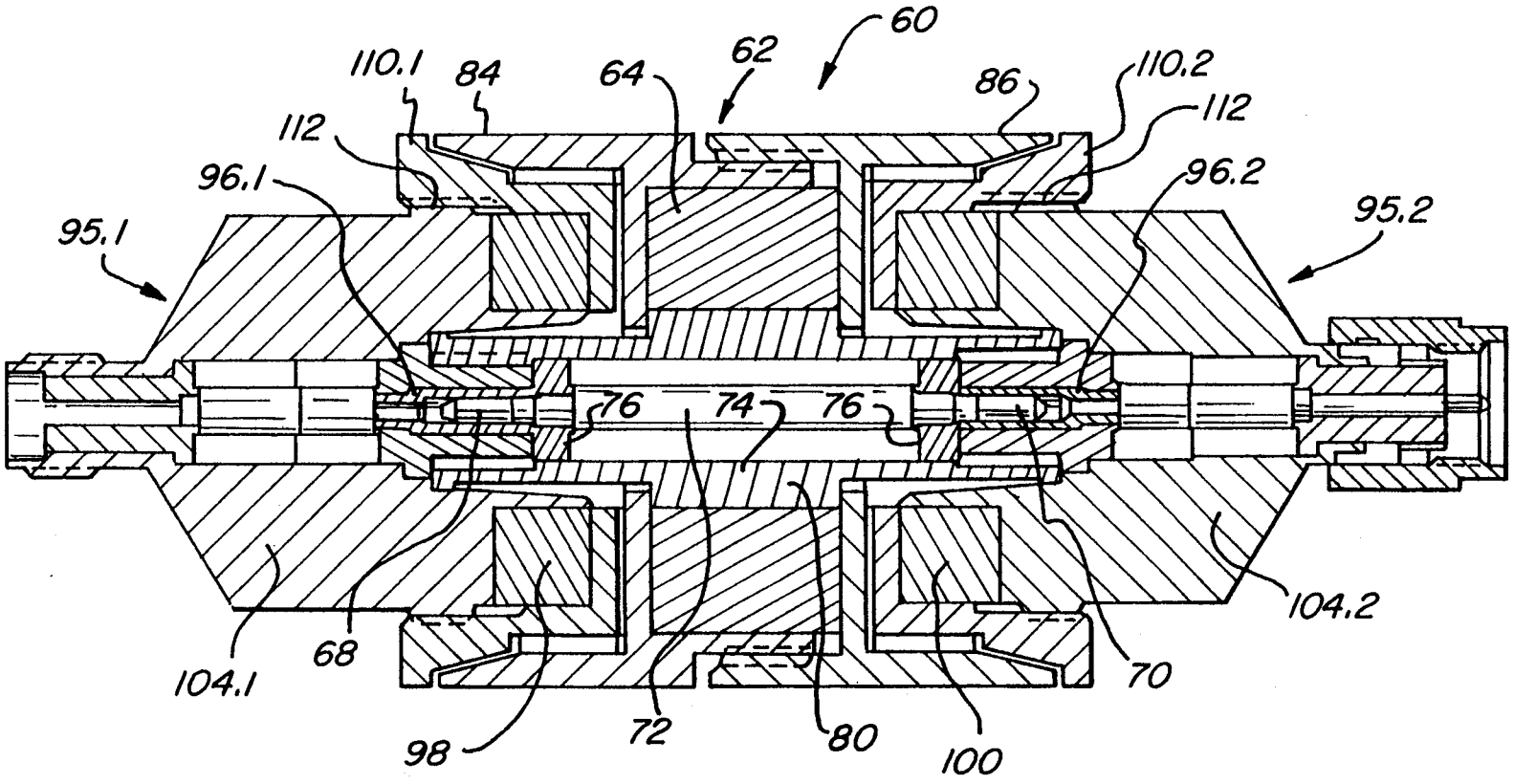
FIG. 6 is a section view of another version of a coaxial connector in accordance with the invention.
Figures 7, 8:
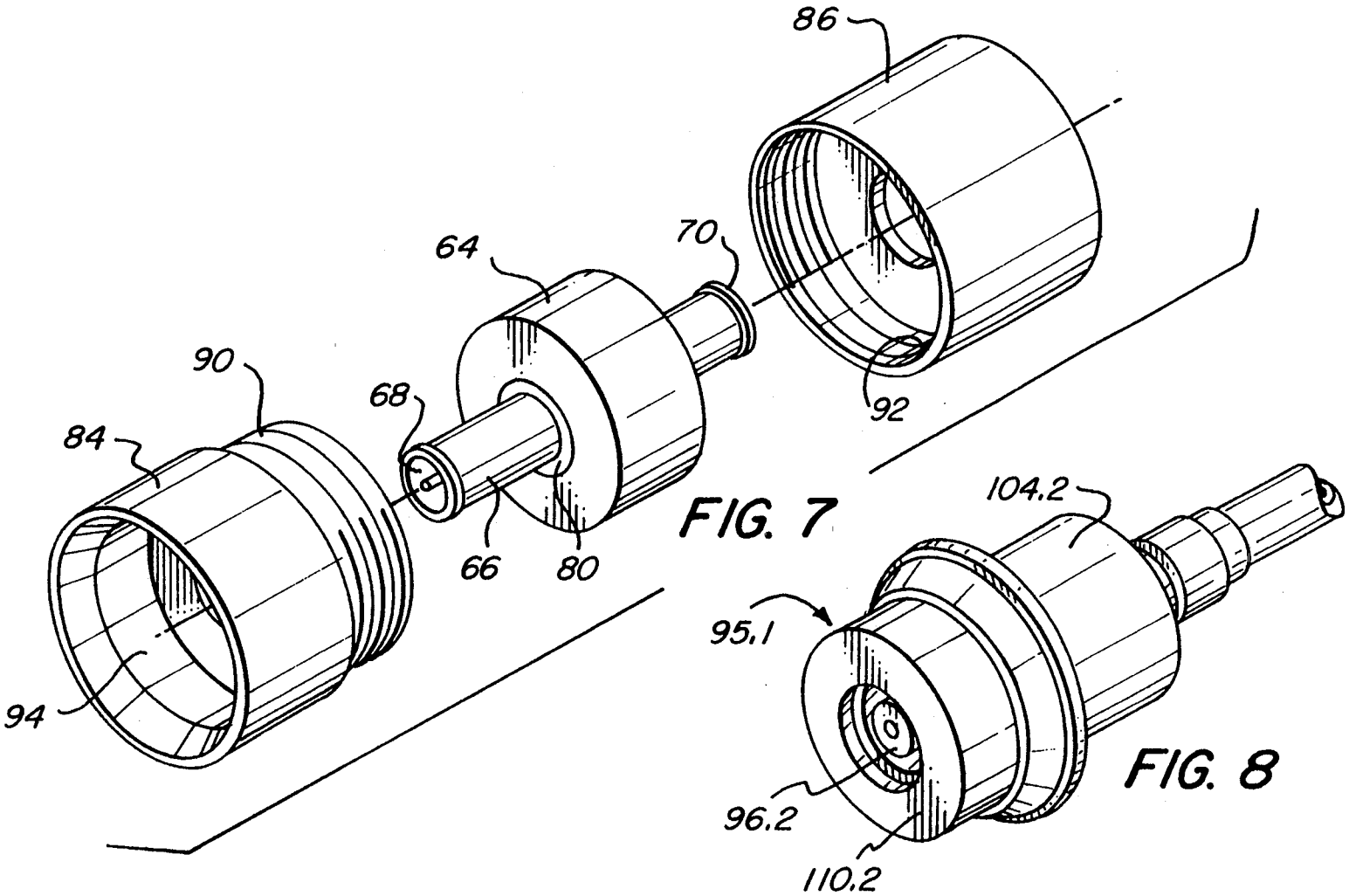
FIG. 7 is a perspective exploded view of part of the coaxial connector of FIG. 6.
FIG. 8 is a perspective view of another part of the coaxial connector shown in FIG. 6.

With reference to FIGS. 6, 7, and 8, a magnetic coaxial connector 60 is shown. Connector 60 includes a central magnetic adapter 62 formed of a ring magnet 64 mounted over a rigid coaxial line segment 66. Coax segment 66 may be sized to fit a standard coaxial cable configuration with female or male ends 68, 70. In the embodiment, male ends 68, 70 are used at the end of a center conductor 72 which is spaced from an outer conductor 74 with annular insulative spacers 76.

The ring magnet 64 fits around a radially raised edge 80 of outer conductor 74 and is held in place with non-magnetic clamping rings 84, 86 that interengage each other with an outer screw thread 90 on ring 84 and an inner meshing screw thread 92 on ring 86. Rings 84, 86 can be made of an insulative material or a metallic non-magnetic material such as brass. Rings 84, 86 seat against axial ends of the raised edge 80.

Each clamping ring 84, 86 has a connector receiving recess 94 shaped and sized to guide and receive connectors 95.1, 95.2 which have female coaxial connector 96.1, 96.2 and engage coaxial ends 68, 70 in a conventional manner. Ring magnets 98, 100 are mounted around ends 102 of a connector body 104, and are held in place with non-magnetic screw caps 110.1, 110.2 which meshingly engage appropriate screw threads 112 on bodies 104.1 and 104.2. Caps 110.1 and 110.2 can be made of an insulative material.

A proper coaxial connection can thus be easily established and maintained by simply pushing connector bodies 95.1, 95.2 into recesses 94 of rings 84, 86. The magnets have sufficient connecting force to hold the connection together. The connection force is dependent upon the size of the magnets 64, 98, and 100.

Having thus shown and described several embodiments for a magnetically held microwave coaxial connector in accordance with the invention, its advantages can be appreciated. Variations from the described embodiments can be made without departing from the scope of the invention as set forth in the claims.

What is claimed is:

1. A microwave coaxial connector comprising:

a push-on, pull-off coaxial connector having a first center electrical conductor surrounded by a first outer conductor, a first magnetic element mounted to a radially outer surface of said first outer conductor and located to provide a magnetic holding force for an end of the coaxial connector a mating coaxial connector having a second center electrical conductor surrounded by a second outer conductor and selected so as to mate with the push-on, pull-off coaxial connector, a second magnetic element mounted to a radially outer surface of said second outer conductor of said mating coaxial connector to enhance the magnetic holding force with the first magnetic element of the push-on, pull-off coaxial connector, and a ring element positioned on the push-on, pull-off coaxial connector to receive the mating coaxial connector.

2. A microwave coaxial connector comprising:

a push-on, pull-off coaxial circuit adapter having a center electrical conductor surrounded by an outer conductor and having ends for mounting coaxial connectors;

a magnetic element mounted to radially outer surfaces of said outer conductor and located to provide a magnetic holding force for the coaxial connectors;

a pair of ring elements connected to each other to cover and retain the magnetic element;

each of said ring elements having a recess sized to receive a magnetically retainable coaxial connector.

* * * * *